United States Patent [19]

Kersey

[11] Patent Number: 4,886,381

[45] Date of Patent: Dec. 12, 1989

[54] DOT MATRIX PRINT HEAD ASSEMBLY

[75] Inventor: Kevin T. Kersey, San Diego, Calif.

[73] Assignee: D. H. Technology, Inc., San Diego, Calif.

[21] Appl. No.: 185,390

[22] Filed: May 6, 1988

[51] Int. Cl.[4] ..... B41J 3/12

[52] U.S. Cl. ..... 400/124; 101/93.05

[58] Field of Search ..... 400/124; 101/93.05; 335/274, 275

[56] References Cited

U.S. PATENT DOCUMENTS

| | | | |
|---|---|---|---|
| 4,049,107 | 9/1977 | Murat | 400/124 |
| 4,230,038 | 10/1980 | Hebert | 400/124 X |
| 4,433,927 | 2/1984 | Cavallari | 400/124 |
| 4,600,321 | 7/1986 | Kwan | 400/124 |
| 4,613,242 | 9/1986 | Forsyth | 400/124 |
| 4,626,115 | 12/1986 | Norigoe | 400/124 |

FOREIGN PATENT DOCUMENTS

| | | | |
|---|---|---|---|
| 48371 | 3/1985 | Japan | 400/124 |

*Primary Examiner*—Paul T. Sewell

*Attorney, Agent, or Firm*—Klaas & Law

[57] ABSTRACT

A dot matrix print head assembly comprising a plurality of print wire members mounted in a wire guide housing and being operably associated with rigid armature members and electromagnet units in an electromagnetic drive housing with a transverse pivotal edge on each of the armature members pivotally supported by a flat pole end surface; the electromagnetic unit comprising a coil and a bobbin connected to a printed circuit board; and the electromagnetic unit being surrounded by and fixedly located within a block of plastic material.

53 Claims, 7 Drawing Sheets

DOT MATRIX PRINT HEAD ASSEMBLY

BACKGROUND OF THE INVENTION

This invention relates to a non-ballistic type dot matrix wire print head apparatus. Dot matrix wire print head apparatus may be generally classified as being of the ballistic type wherein the print wire members are not connected to the drive armatures and are driven by impact with the drive armatures, or the non-ballistic type wherein the print wire members are fixedly connected to the drive armatures so that the print wire members and armatures have unitary movement. While the features of the present invention are disclosed in conjunction with a non-ballistic type print head assembly, certain features may also be utilized with a ballistic-type print head assembly.

In prior art ballistic-type apparatus, such as that disclosed in U.S. Pat. Nos. 4,230,038, 4,230,412, 4,185,929 and 4,478,528, the disclosures of which are incorporated herein by reference, wire type printing members (stylus or styli) are arranged in spaced relationship about a central longitudinal axis in a generally circular or elliptical matrix for reciprocable movement between a non-print position and a print position with the movement from the non-print position to the print position being of ballistic nature, i.e. by impact and/or driving engagement with another moving member. Each printing member is operatively associated with a radially innermost portion of a radially outwardly extending armature member and ballistically driven thereby by impact therewith during pivotal movement of the armature from a non-print position to a print position. A radially outermost portion of each armature is operatively associated with a radially outwardly located and circumferentially spaced electromagnetic means having radially spaced pole portions including a radially innermost pole portion and a radially outermost pole portion, the pole portions including flat coplanar radially spaced and radially extending end surfaces which face away from the direction of movement from the non-print position to the print position and engaging a side surface of the armature at various times.

In some types of the prior art ballistic-type apparatus, the construction and arrangement is such that the armature is pivotally supported at all times on a radially outermost edge of the end surface of the radially outermost pole portion and impacts the end surface of the radially innermost pole portion which is constructed and arranged to cause pivotal movement of the armature from the non-print position to the print position by magnetic attraction. In addition, the construction and arrangement is such that the armature impacts on the end surface of the innermost pole portion at approximately the same time that the printing member is being driven toward the paper. The result is that the kinetic energy of the armature is lost and only the kinetic energy of the printing member is thereafter effective to cause completion of the printing operation. The lost kinetic energy is simply dissipated upon impact with the surface of the pole portion with resultant high levels of noise and heat. In addition, the speed of the printing process is reduced and the number of sheets of paper which can be printed at one time is also limited. Furthermore, in order to obtain sufficiently high levels of kinetic energy to produce satisfactory printing results, relatively high levels of energy must be used to operate the electromagnetic means.

In the invention disclosed in U.S. Pat. No. 4,230,038, the armature members and the electromagnetic means are constructed and arranged so that the armature members are normally pivotally supported by a first pivot means on a radially innermost edge of a radially innermost pole portion while being magnetically attracted by a radially outermost pole portion. In addition, the pole portions are constructed and arranged so that the end surfaces thereof face toward the direction of movement of the armature and the printing members from the non-print position to the print position. As a result, the driving movement of the armature continues after impact with the end surface of the outermost pole portion without loss of a substantial portion of the kinetic energy thereof as in prior art apparatus. Furthermore, the construction and arrangement is such that after impact of the armature with the end surface of the outermost pole portion, the first pivot means is disengaged and a second pivotal means is provided between a radially outermost portion of the armature and the radially outermost edge of the radially outermost pole portion whereby the driving movement of the armature may continue substantially unimpeded until completion of the printing operation.

For many years, there has been a trend toward the use of smaller size, dot matrix print head assemblies operating at relatively high speeds with maximum efficiency. There has also been a trend toward use of more print wire members in each dot matrix print head assembly and dot matrix print assemblies having at least 18 or more print wire members has become commonplace. It is often desirable to reduce the size of the print head assemblies which results in difficulty of assembly, repair and maintenance and increased costs of manufacture. At the present time, there is a need for a relatively low cost and relatively small size, yet highly efficient, dot matrix print head assembly which is easy to assemble and be mounted on a printer mechanism.

Objects of the present invention are to provide a high speed, reliable, efficient, compact, lightweight, low cost and easily manufacturable dot matrix print head assembly. The invention provides a dot matrix print head assembly which (1) reduces the mass of moving parts; (2) reduces print wire resonances; (3) employs a laminated electromagnet construction with improved flux concentration and low inductance and low current; and (4) employs an armature and pole construction.

Another object of the present invention is to provide a relatively small size, e.g. approximately 2 inch diameter by 1½ inch length, print head assembly with a relatively large number of print wires, e.g. 24 print wire members. It is also an object of this invention to provide a construction and arrangement which enables the parts to be manually assembled with a minimum of time and effort while also providing maximum accuracy of critical relationships between the operational components.

SUMMARY OF INVENTION

The present invention provides a print head assembly comprising only two basic unitary sub-assemblies for receiving and retaining the armature members and the print wire members. One unitary sub-assembly comprises a print wire housing with an integral armature retaining flange made of one piece of molded plastic material. The other unitary sub-assembly comprises the electromagnetic pole means and a printed circuit board means which are permanently fixedly embedded (e.g. potted) within a drive housing means made of one piece of molded plastic material. The construction and arrangement is such that the wire housing means and the drive housing means are directly connected to one another by suitable fastening means with the armature members and print wire members mounted therewithin and therebetween. In the presently preferred embodiment, the armature members are fixedly connected to the print wire members to provide individual combination print wire and armature subassemblies operable in a non-ballistic mode of operation and to reduce the number of parts and facilitate assembly and repair or replacement.

In addition, the present invention provides a new and improved armature construction and arrangement wherein pivotal edge means are provided on each armature rather than on a pole portion of the electromagnet means and a flat pole end surface provides a pivotal edge support means for each armature member. The present invention also provides a new and improved construction and arrangement of the armature members and associated armature guide and retaining means wherein each armature is retained by a pin means extending through a centrally located opening means in the armature. The pivotal edge means of each armature is held in continuous abutting engagement with the associated flat pole end surface by a biasing means in the form of a resilient compressible O-ring member.

The present invention relates to a non-ballistic type dot matrix print head wherein the print wire is attached to the armature tip. When the electromagnet is energized, the magnetic end of the armature is attracted to a pole end surface and the print wire is driven outward to the print position. The wire impacts the paper before the armature fully engages ("bottoms out") on the pole end surface to create a rebound force which reverses the motion of the wire and the armature to return the armature and print wire to the original non-print position. An armature stop means damps the return motion and re-locates the armature and wire in the non-print position. A return spring means acts as a static biasing force on the armature to keep it in place in the non-print position.

The present invention also provides a new and improved construction of the electromagnet means to maximize concentration of flux and speed of response. One of the features of the present invention is the shape of the magnetic yoke. The "space" in between the two pole portions is relatively large to reduce magnetic flux leakage. In addition, the inner pole curves in toward the outer pole adjacent the pole end surfaces to provide a "C" shape gap resulting in greater efficiency and speed of magnetic response for a relatively small armature which operates at high speed. The pole end portions have a "chamfer" which concentrates the magnetic flux. In the presently preferred embodiment, the yoke has a laminated stack design which improves efficiency and speed of magnetic response. Since the pivot edge means is on the armature rather than on the pole as has been the conventional approach, the magnetic yoke assembly is easier to manufacture with improvement in the functional tolerances of the assembly.

The contour of the armature is designed to be optimum magnetically, and to have minimum inertia. The armature is provided with a central transverse retaining means in the form of a hole for receiving a pin, rather than the use of peripheral slots or tabs to retain the armature in place. This design enables use of a single round hole which locates on a loose fitting plastic "peg" in the wire housing. This design is easier to manufacture and allows a more compact design.

The return spring means are provided by two elastomeric O-rings which are located in the wire housing and are compressed against the armature side surfaces opposite the pole portions. One of the O-rings is directly over the pivot point to continuously maintain the armature pivot edge in engagement with the pole end surface. The other O-ring is radially inwardly offset from the pivot, and acts as the return spring. In prior art non-ballistic designs, separate individual coil springs or leaf springs have been used for each armature in the print head. The O-ring design allows the use of one single inexpensive part for the return spring of all actuators in the print head; provides better damping characteristics than metal springs, and is more compact than most other prior art designs.

The present invention also provides an improved "magnetic yoke assembly". In other designs, the magnetic yokes (metal) are one sub-assembly, and the coils/PC board are another. In the present design, all parts "snap" together and then the whole assembly is molded in thermoset plastic for rigidity. In the assembly procedure, the coils are wound on their bobbins, and the leads are terminated on pins in the bobbin in a conventional manner. Then the magnetic yokes are snapped into the coils, and the coils then snapped into a PC board, along with the connector. Then, the coils and connector are soldered to the PC board. Lastly, this assembly is all "potted" with a thermoset plastic to create a rigid assembly. Subsequently, the pole end portions of the magnetic assembly are ground flat (lapped) as a unit to create planar end surfaces and smooth flat abutment surfaces for pivotally supporting the armatures. Thus, the parts are "self-fixturing", whereas most other designs require assembly fixtures to build the assembly.

Spring-loaded armature stop means are provided to set the length of the stroke of the armatures solely based on the thickness of a shim. In other designs, the stroke (a highly critical item) is either adjusted in production, or is determined by the combination of several dimensions. By spring-loading the armature stop against a reference plane, the stroke is determined by the shim only, eliminating any adjustment in production, and improving the tolerance of the stroke dimension.

In general, this invention provides a wire matrix print head assembly and apparatus which is less costly to manufacture and more reliable in operation while also being more efficient, less noisy, and having higher energy, and speed potential than prior art apparatus.

The present invention provides a print head wherein the moving masses are extremely low. The magnetic system has a very quick response time, with a high accelerating force for its relatively small size and is extremely efficient. The low mass and high force produce high accelerations (therefore high speeds), and the high efficiency reduces overheating, and allows smaller (lower power) drive electronics. Another unique feature is that all of this performance is achieved using conventional materials and in a simple, manufacturable design.

BRIEF DESCRIPTION OF THE DRAWING

An illustrative and presently preferred embodiment of the invention is shown in the accompanying drawing wherein.

GENERAL ASSEMBLY

Figure 1:
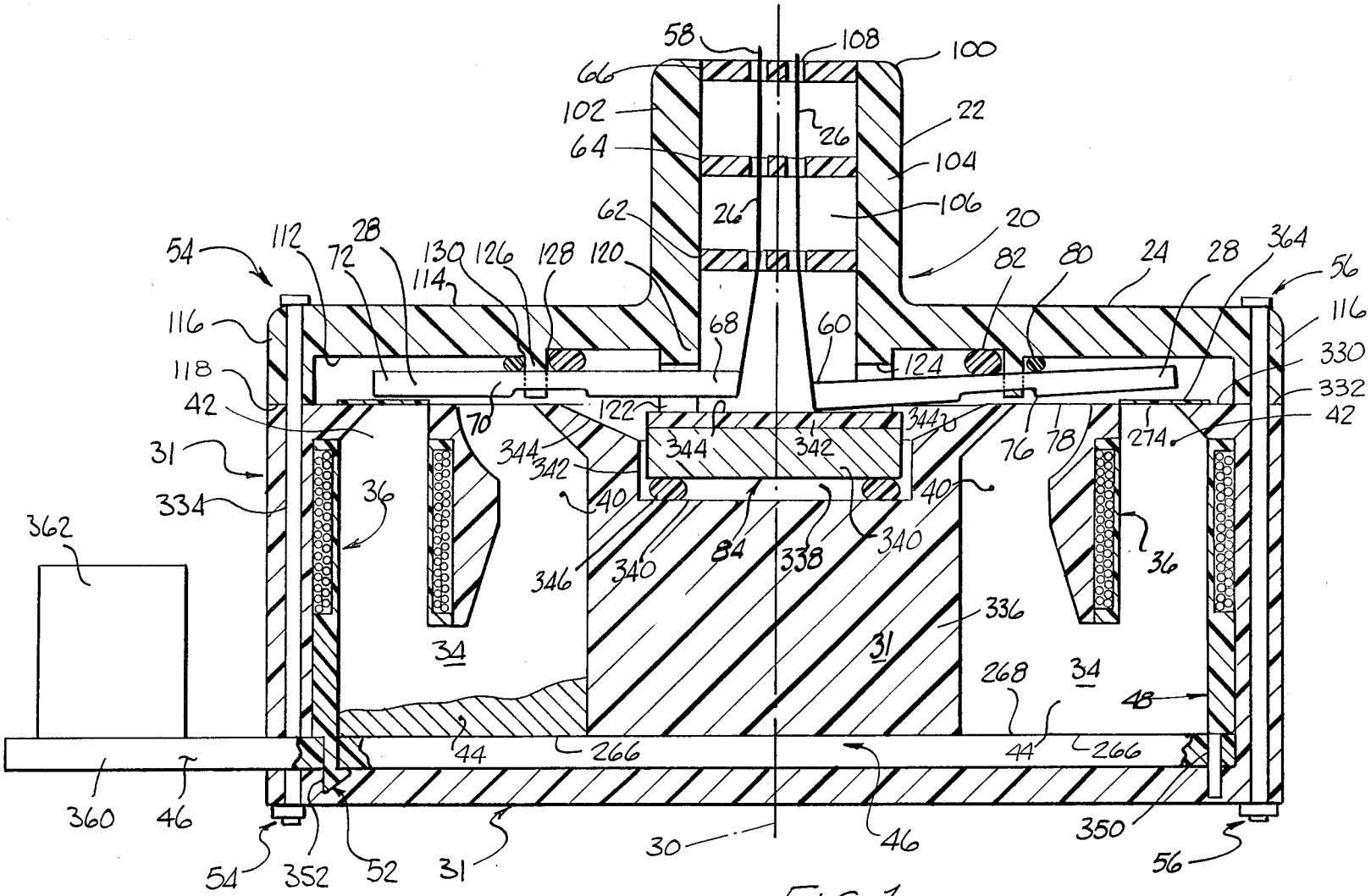
FIG. 1 is a cross-sectional view of a dot matrix print head assembly constructed and arranged in accordance with the present invention.

In general, FIGS. 1–4 show a non-ballistic-type dot matrix print head which comprises a wire housing means member 20 having an elongated print wire guide and support portion 22 and an annular armature retaining flange portion 24 for supporting a plurality of elongated wire stylus print members 26, eg. 24, and an equal number of armature members 28 in radially and circumferentially spaced relationship about a central longitudinal axis 30. The print head apparatus further comprises electromagnetic drive housing means 31 for supporting an equal number of armature actuating magnetic pole means 34 and electrical wire coil means 36 located in radially and circumferentially spaced relationship about central axis 30 in juxtaposition to and operative relationship with the armature members 28. Each of the pole means 34 have a radially innermost pole portion 40, a radially outermost pole portion 42 and a connecting portion 44 which is mounted on a printed circuit board means 46. Coil means 36 are electrically connected to the printed circuit board means 46 by connector pin means 48 mounted on bobbin means 50, FIGS. 9–12, which may have snap-in holding means 52 for engagement with the printed circuit board means 46. The print wire housing means 20 is fastened to the drive housing means 31 by suitable fastener means 54, 56.

Each of the wire print members 26 has a paper impacting print end portion 58 and a drive end portion 60 fixedly attached to an associated armature member. The wire members 26 are slidably reciprocably supported by guide and bearing plate members 62, 64, 66 for movement between a retracted non-print position and an extended print position. Each of the armature members 28 has a radially innermost wire drive end portion 68, a central intermediate pivot portion 70 located opposite inner pole portion 40, and a radially outermost magnetic drive end portion 72 located opposite outer pole portion 42. The armature members 28 are pivotally movable between a non-print position (schematically illustrated on the right side of FIG. 1) and a print position (schematically illustrated on the left side of FIG. 1) by selective energization of the associated electromagnetic means 34. Each of the armature members has a pivotal edge means 76 held in continuous abutting engagement (see FIG. 4) with a flat inner pole end surface 78 by a resilient compressible pivot spring means in the form of an O-ring member 80. A resilient compressible armature return spring means in the form of an O-ring member 82 continuously engages each armature member to provide an armature return force. A resilient compressible armature stop means 84 engages and locates the armature wire drive end portions 68 in the non-print position and dampens armature rebound during return movement from the print position to the non-print position.

Wire Housing Means

Figure 2:
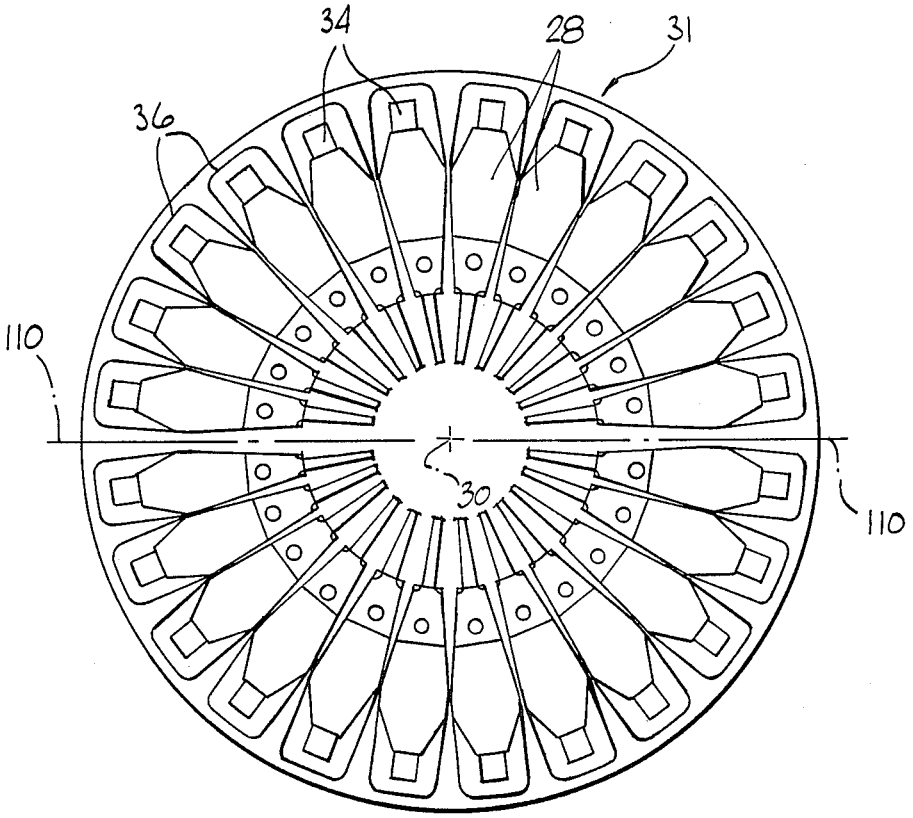
FIG. 2 is a reduced size plan view of the armatures and drive assembly of the dot matrix print head of FIG. 1.
Figure 2A:
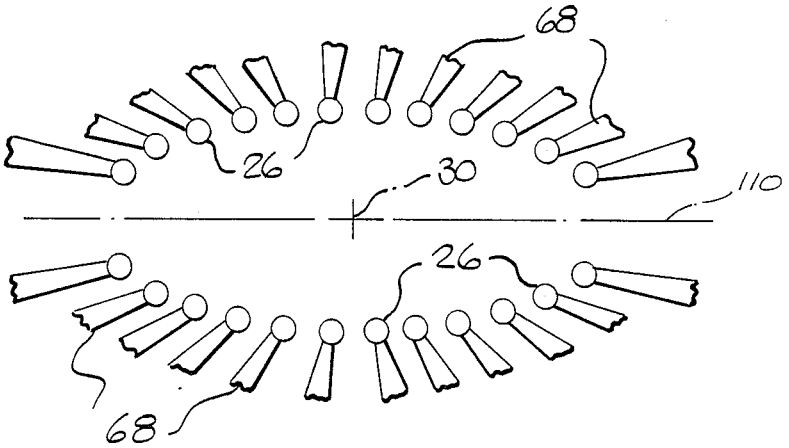
Figure 3:
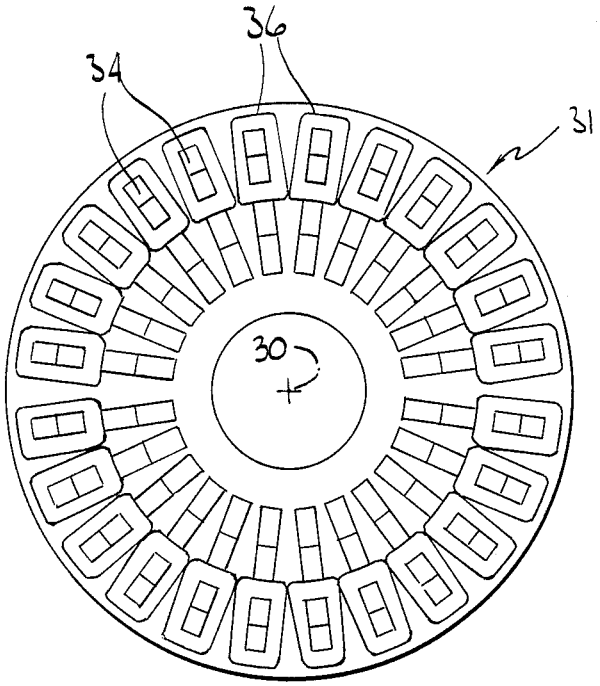
FIG. 3 is a reduced plan view of the drive assembly of FIG. 2 without the armature.

The wire housing means 20 is preferably made of one piece of rigid molded plastic material. Guide and support portion 22 comprises an elongated portion 100 of generally U-shaped peripheral configuration defined by a pair of spaced side wall portions 102, 104 and a connecting wall portion providing an elongated slot 106 therebetween. Axially spaced wire guide plate members 62, 64, 66, are preferably made of suitable molded plastic material and have suitably shaped wire guide and bearing holes 108 provided therein in variable radially outwardly spaced relationship to central axis 30. As shown in FIGS. 2 & 3, one half of the wire members are located on one side of central axis 110 and the other half of the wire members are located on the other side of axis 110. The print end portions of each group of wire members are arranged in a column pattern and provide two spaced rows of wire members. In the presently preferred embodiment, there are 12 wires in each row.

Figure 4:
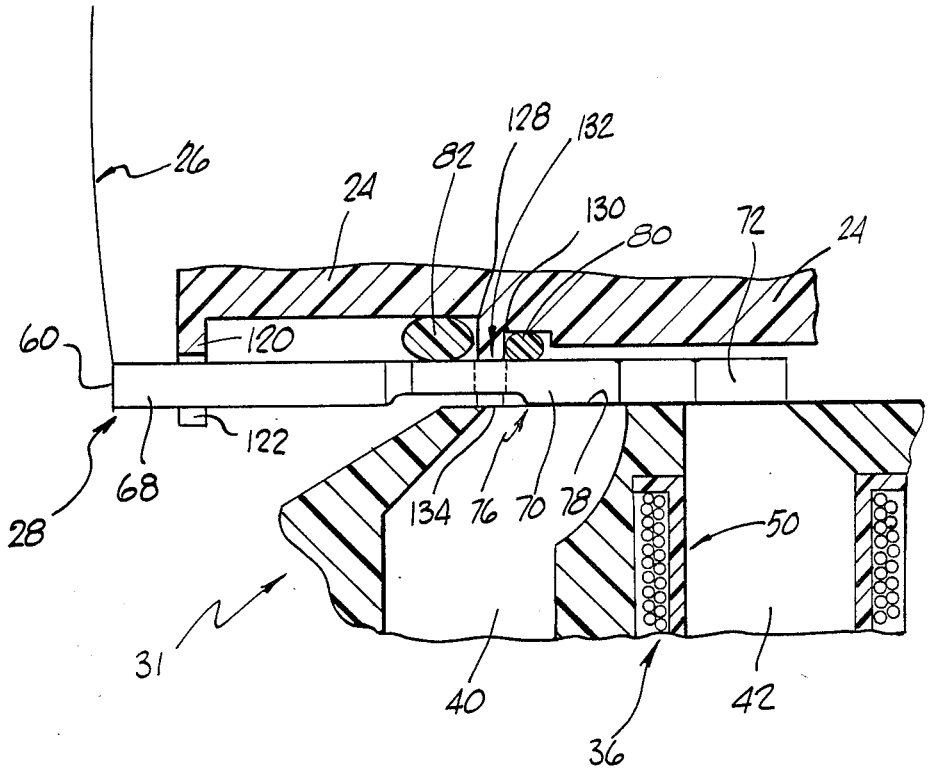
FIG. 4 is an enlarged partial side elevational view of an armature and electromagnet of FIG. 1.

The flange portion 24, FIGS. 1 & 4, comprises inner and outer radially extending surfaces 112, 114 and an axially extending outer rim portion 116 having an abutment surface 118 for supporting engagement with drive housing means 31. An inner rim portion 120 is provided with radially innermost armature mounting and guide slot means 122 circumferentially spaced thereabout. Each slot means 122 comprises circumferentially spaced parallel side surfaces and a radially extending flat bottom surface 124. The armature mounting and guide and slot means loosely receive the radially innermost armature end portions and enable free pivotal movement between the non-print and the print position.

A radially intermediate axially inwardly extending second inner rim portion 126 is radially outwardly spaced from rim portion 120 and located in juxtaposition to inner pole portions 40. Rim portion 126 provides a first radially innermost annular O-ring groove 128 in which is mounted a resilient compressible relatively large diameter O-ring member 82 for continuously engaging an intermediate portion of armatures 28.

Rim portion 126 also provides a second radially outermost annular O-ring groove 130 in which is mounted a resilient compressible relatively small diameter O-ring 80 for continuously engaging a portion of the armatures 28 opposite pivotal edge means 76. Rim portion 126 also provides armature guide and retaining means 132, FIG. 4, in the form of a plurality of circumferentially spaced cylindrical axially extending stub shaft portions which are loosely received in centrally located bores in the armature members as hereinafter described. Stub shaft portions have coplanar end surfaces 134 which are abuttingly engaged with inner pole end surface 78.

The Armature Members

Figure 5:
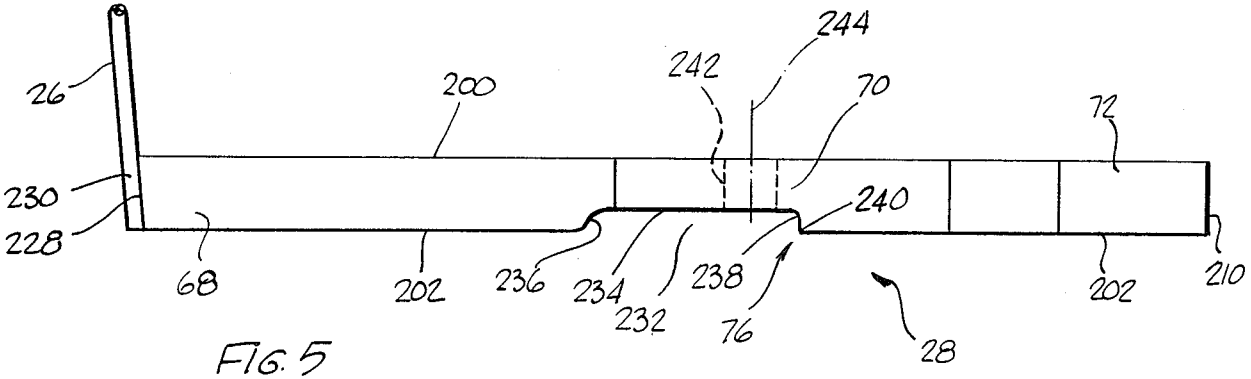
FIG. 5 is an enlarged side elevational view of the armature of FIG. 2.
Figure 6:
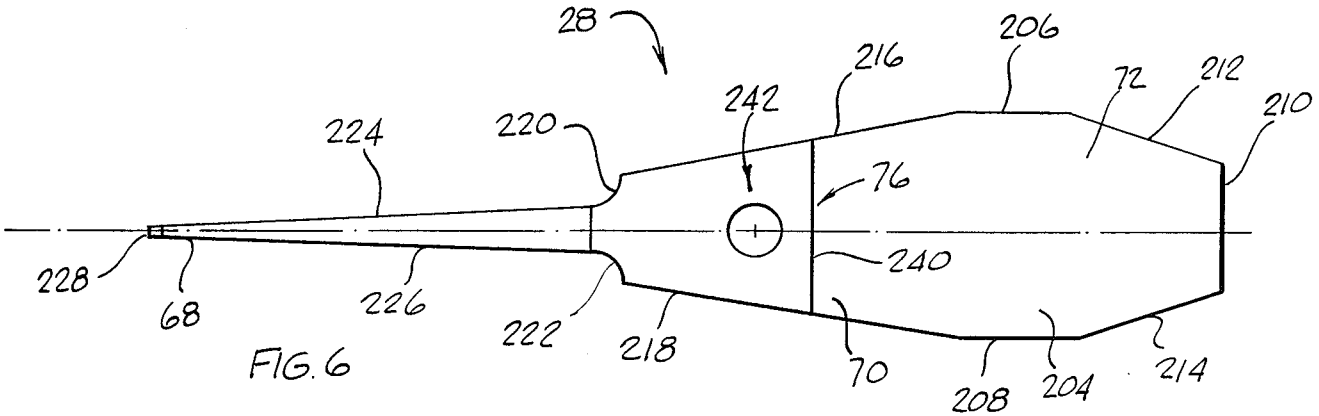
FIG. 6 is a plan view of the armature of FIG. 5.

As shown in FIGS. 5 and 6, each of the armature members 28 have flat parallel side surfaces 200, 202. Actuating end portion 72 has an intermediate maximum width portion 204 located between flat parallel intermediate surfaces 206, 208 which are connected to radially outermost flat end surface 210 by inclined surfaces 212, 214. Inclined surfaces 216, 218 extend radially inwardly from intermediate portion 204 to inwardly curved side surfaces 220, 222 which tangentially intersect inclined side surfaces 224, 226 of relatively narrow width elongated wire drive end portion 68. Drive end surface 228 is inclined at an angle of approximately 4.2 degrees for abutting fixed engagement with the end portion 230 of the associated wire member by brazing. The width of surface 228 is approximately equal to the diameter of the wire end portion 230 (e.g., approximately 0.008 inch).

Each of the armature members has an intermediate transverse slot 232 defined by an offset flat surface 234 and side wall surfaces 236, 238. Slot side surface 238 intersects side wall surface 202 at a substantially right angle to provide a sharp transverse edge 240 providing transverse line-type armature pivot means. Armature retaining means in the form of a centrally located circular hole 242 extends through the armature opposite slot 232 adjacent pivot means 76. The circular shaft means 132, FIG. 4, on retainer flange portion extends through circular hole 242 opposite the end surface 78 of the inner pole portion 40 for abutting engagement with inner pole end surface 134. The diameter of hole 242 (e.g., 0.040 inch) is sufficiently larger than the diameter of shaft 132 so as to enable free pivotal movement of the armature. The depth of slot 232 (e.g., 0.015 inch) is such as to enable free pivotal movement of the armature without contact with the inner pole portion 40 or adjacent portions of drive housing 31. The width of the wire drive end portion tapers from 0.030 inch at the intersection with curved surfaces 220, 222 to 0.008 inch at drive end surface 228. The armature members have a length of approximately 0.70 inch and a thickness of approximately 0.050 inch and a maximum width of approximately 0.150 inch. The width of slot 232 is approximately 0.148 inch and the center line 244 of hole 242 is located approximately 0.040 inch from pivot edge 240. Drive end surface 228 is located approximately 0.389 inch from hole center line 244. Actuating end surface 210 is located approximately 0.316 inch from hole center line 244 and has a length of approximately 0.084 inch.

Electromagnet Means

Figure 8:
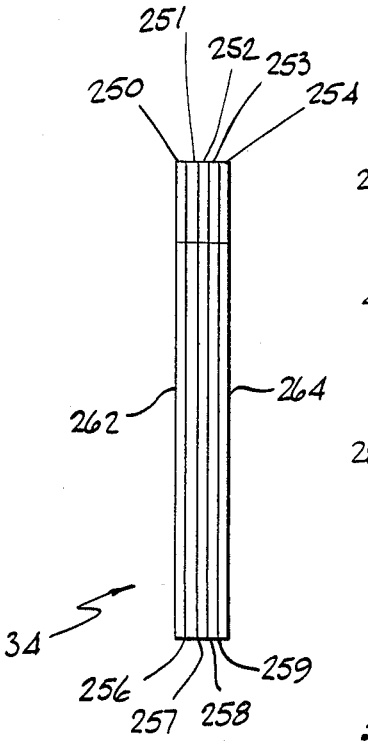
FIG. 8 is an end view of the magnetic yoke of FIG. 7.
Figure 7:
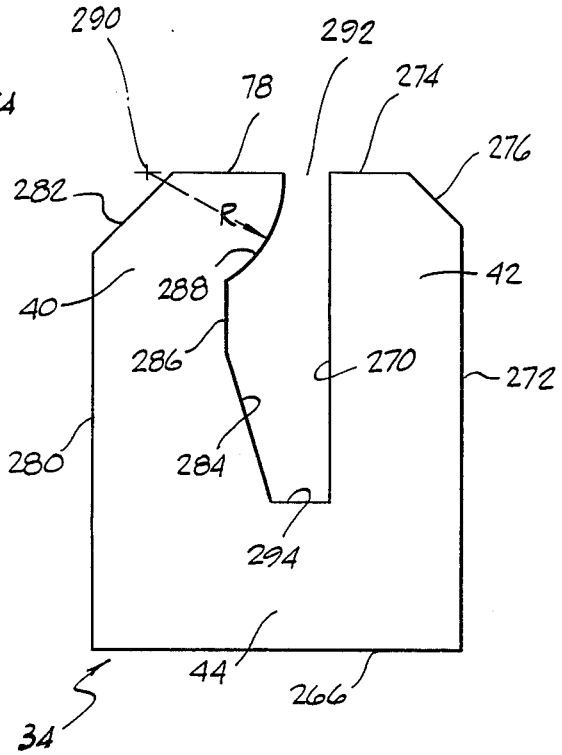
FIG. 7 is an enlarged side elevational view of the magnetic yoke of the apparatus of FIG. 1.
Figure 12:
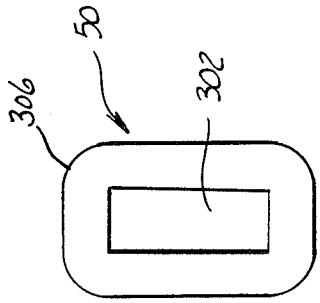
FIG. 12 is another end view of the bobbin of FIG. 9.
Figure 9:
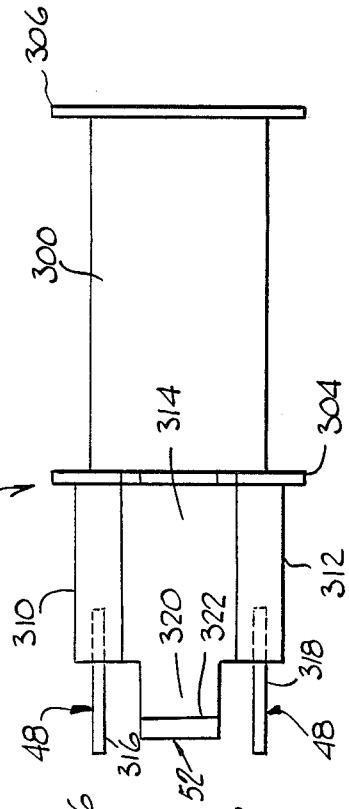
FIG. 9 is a side elevational view of a bobbin.
Figure 10:
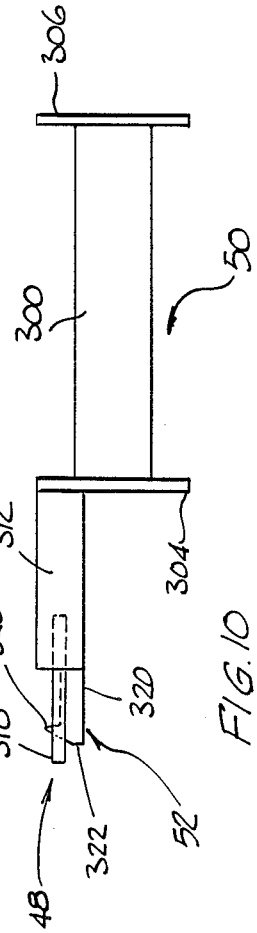
FIG. 10 is another side elevational view of the bobbin of FIG. 9.
Figure 11:
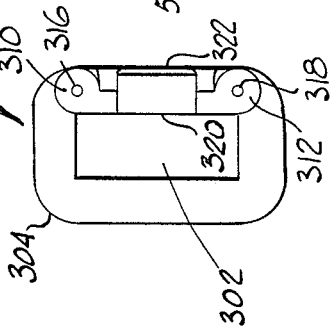
FIG. 11 is an end view of the bobbin of FIG. 9.

As shown in FIGS. 7 & 8, each of the pole means 34 preferably have a laminated construction made of a plurality of relatively thin metallic plate members 250, 251, 252, 253, 254 separated by very thin insulating coating or spacer members 256, 257, 258, 259. Each pole unit has flat parallel side surfaces 262, 264 and a flat end surface 266 which abuts a flat side surface 268 of printed circuit board means 46 as shown in FIG. 1. Outer pole portion 42 has straight parallel inner and outer side surfaces 270, 272, a flat pole end surface 274, and an inclined chamfer surface 276. Inner pole portion 40 has a flat straight outer side surface 280 and an inclined surface 282 connected to inner pole end surface 78. The inner side surface of inner pole portion 40 comprises an inclined flat straight surface 284, an intermediate straight flat surface 286, and a curved upper surface 288 having a relatively large radius of curvature (e.g., 4.50 MM) with a center of curvature located at 290 in the plane of inner pole end surface 78 which is coplanar with outer pole end surface 274. Inner pole end surface 78 has a longer length (e.g., approximately 3.75 MM) than the length of outer pole end surface 274 (e.g., approximately 2.75 MM). Inner pole curved surface 288 provides a minimum air gap between the pole portions 40, 42 of approximately 1.5 MM at 292 between pole end surfaces 78, 274. A maximum air gap of approximately 3.5 MM is provided between opposite parallel straight pole side surfaces 270, 286. Connecting side surface 294 has a length (approximately 2.0 MM) greater than the pole end surface gap 292.

As shown in FIGS. 9–12, the bobbin means 50 is made of one piece of plastic material and comprises a core portion 300 with a pole mounting slot 302 and coil wire retaining end flanges 304, 306. A connecting portion 308 extends outwardly axially from flange portion 304. Connecting portion 308 has laterally spaced hub portions 310, 312 connected by an intermediate portion 314. Connector pin members 316, 318 are mounted in hub portions 310, 312 and connected to the end portions of the coil wire. Retaining tab means 52 comprises a flexible flange portion 320 having a flexible lip portion 322.

Drive Housing Means Assembly

As shown in FIG. 1, drive housing means 31 comprises a one piece body of plastic material having a flat end surface 330 which is coplanar with pole end surfaces 78 and provides an abutment surface 332 for engaging retaining flange rim portion 116. Fastener holes 334 receive fastening members 56. A central portion 336 has a recessed central cavity 338 with a flat bottom wall 340 and an annular side wall 342 connected to end surface 330 by a tapered side wall 344.

Armature stop means 84 is mounted in central cavity 338. Stop means 84 comprises a rigid support disk member 341 which supports a resilient cushion member 343 having a flat upper surface 345 for engaging the wire drive end portions of the armatures in the non-print position. A spring means in the form of a resilient compressible O-ring member 346 supports disk member 341.

The drive housing means 31 is molded around the electromagnet means 34, the coil means 36, and the printed circuit board means 46 by a potting operation. The coil means 36 are first mounted on the pole means 34 by a sliding frictional fit to provide individual electromagnetic unit sub-assemblies. Then, the electromagnetic unit sub-assemblies are fixedly mounted on the printed circuit board means 46 with pole end surfaces 266 located in coplanar abutting relationship on printed circuit board surface 268, coil wire connector pin means 48 located in PC circuit connector holes 350, and bobbin retaining flange means 52 located in PC slots 352. Thus, the electromagnetic means and PC board means form another unitary sub-assembly which is then embedded in a body of plastic material 31 providing a drive housing assembly. A portion 360 of the PC board extends beyond the drive housing and has a control circuit connector means 362 for connection to control circuitry of an associated printer mechanism. Then, the drive housing side surface 330 and the pole end surfaces 78, 274 are precision ground to provide coplanar end surfaces. Fastener bores 334 and cavity surface 340 are created by the molded plastic material 31.

The dot matrix print head assembly is completed by placing the stop means 84 in central cavity 338. The O-ring members 80, 82 are mounted on pre-assembled retaining flange portion 24. Then, the pre-assembled armature and print wire units are mounted in the wire housing means 20 with the armature members associated with the guide slots 122 and guide shaft portions 132 of the retainer flange portion 24. A conventional thin annular anti-residual shim ring member 364 may be located between the armature members 28 and the outer pole portions 42. The wire housing means 20 is then fastened to the drive housing means 31 by fastening members 56. Suitable printer mounting means (not shown) are provided on each print head assembly for mounting on a printer mechanism.

Print Head Operation, Characteristics & Parameters

In the illustrative embodiment, there are 24 print wires made of tungsten carbide material of 0.008 inch diameter which are arranged to provide an output pattern comprising two staggered columns of 12 print wires. The print head assembly has a weight of approximately 150 grams and a diameter of approximately 2 inches. The print head is operable at 40 volts (minimum), 2 to 2.5 amps with a chopper or bi-level driver. The coils have a resistance of approximately 1.8 ohms and an inductance of approximately 1.2 mH. The print wire frequency is approximately 3KHz with a stroke of approximately 0.016 inch and heat generation per dot of approximately 1 mJ.

The contour of the yoke gap with minimum spacing between the pole end surfaces and maximum spacing between the intermediate pole portions reduces magnetic flux leakage and provides higher efficiency and speed with lower heat generation, while enabling the use of a small and extremely low inertia armature for high speed operation. The chamfer at the top of the outer pole operates in conjunction with the "low flux leakage" gap design to further concentrate the magnetic flux.

The slot in the armature provides a pivotal edge means on the armature rather than on a pole end surface whereby the end surface of the "potted magnetic assembly" is ground or lap-finished to provide coplanar pole end surfaces with reduction in mechanical tolerance requirements in the assembly.

The armature retaining hole and sub shaft means greatly simplifies the construction and arrangement of the armature members and the retaining flange means by elimination of additional slot and tab structure while simplifying manufacturing problems.

The construction and arrangement of the two armature biasing and location O-rings for pivot retention and for return spring action is simpler, less expensive and more compact than conventional designs while providing improved damping properties.

The self-fixturing "snap together" design of the magnetic yoke and PC board sub-assembly greatly reduces costs while also enabling precision alignment of the parts. The PC board provides a support base for the electromagnet means with the bobbin connector means inserted into opening therein. Then the pin connections are soldered to the PC board and the potting compound is molded around all the parts for rigidity with minimal fixturing being required. This concept eliminates all conventional "structural" members in the assembly operation, such as metal support plates.

The "spring-loaded" armature stop means eliminates the use of either an adjustment in manufacturing, or high tolerance grinding or machining to set the depth of the armature stop assembly, which determines the armature stroke (a highly critical parameter). Some other designs use shims, individually selected for proper fit. The present concept uses a biasing spring in the form of an elastomeric O-ring which holds the armature stop assembly against a reference surface means in the form of the end surfaces of guide slots 122 on the molded plastic wire housing flange portion so that the wire stroke is not affected by variations in the thickness of the assembly parts. Another advantage is that other stroke settings may be made by simply assembling with an appropriate shim (not shown) in between the armature stop means assembly and the reference surfaces.

In operation, the armature members are located in the non-print position by stop means 84 and O-ring members 80, 82. Upon selective energization of one of the coil means 36, the associated one of the armature members 28 is pivotally actuated from the non-print position to the print position about pivotal means 76. O-ring member 80 exerts a force-keeping pivotal means 76 in continuous engagement with inner pole end surface 78 and preventing armature contact with the retaining flange portion 24. After the print wire impacts the print medium in the print position and begins to rebound toward the non-print position, O-ring member 82 is effective to provide a return spring force on the armature. When the armature returns to the print position, it engages the resilient stop and damping means 84.

While illustrative and presently preferred embodiments of the invention have been disclosed herein, it is contemplated that the inventive concepts may be otherwise variously employed in alternative constructions and arrangements of dot matrix print head devices. For example, various concepts may be employed with either a ballistic-type or a non-ballistic-type print head. Thus, it is intended that the appended claims be construed to include various alternative construction and arrangements except insofar as limited by the prior art.

What is claimed is:

1. A matrix print head assembly comprising:

a number of print wire members spaced about a central longitudinal axis and being longitudinally movable between a non-print position and a print position;

wire guide housing means for movably supporting said wire members;

a number of rigid armature members equal to the number of wire members movable between a non-print position and a print position and extending radially outwardly of and being circumferentially spaced about the central longitudinal axis with a radially inner portion being driveably associated with said wire members during movement from the non-print position to the print position to drive the wire members from the non-print position to the print position;

a number of separate circumferentially spaced electromagnet means equal to the number of armature members mounted in juxtaposition to a radially outer portion of said armature members for pivotally supporting said armature members during movement from the non-print position to the print position and being selectively energizable for causing pivotal movement of the radially outer portion of said armature members toward said electromagnet means and opposite pivotal movement of the radially inner portion of said armature members from the non-print position to the print position by magnetic force applied to the radially outer portion;

electromagnetic drive housing means for supporting said electromagnet means in operative relationship with said armature means;

armature retainer flange means on said wire guide housing means for retaining said armature members in operative association with said electromagnet means;

said armature members being positioned between said electromagnet means and armature retainer flange means and said radially innermost portion being movable away from said electromagnetic means toward said armature retainer flange means during movement from the non-print position to the print position;

pivotal support means for continuously pivotally supporting said armature members during the movement of said armature members from the non-print position to the print position;

said pivotal support means comprising a transverse pivotal edge means on each of said said armature members and a flat pivot edge support surface means on said electromagnetic means;

each of said electromagnetic means comprising a radially innermost first pole portion and a radially outermost second pole portion being radially spaced from one another, the first pole portion being next adjacent said wire members and having a flat first pole end surface located adjacent said armature members, the second pole portion being spaced outwardly of said first pole portion a distance further away from said wire members than the distance between said first pole portion and said wire members, and the second pole portion having a flat second pole end surface located adjacent said armature members and being effective to actuate said armature members from the non-print position to the print position;

said pivot edge support surface means comprising said flat first pole end surface of said first pole portion next adjacent said wire members;

first armature retaining guide means in said flange means located radially next adjacent said wire members and located between said wire members and said pivotal support means for guidably supporting said armature members during movement between said non-print position and said print position;

second armature retaining guide means in said flange means located radially outwardly of said first armature retaining guide means and radially inwardly of said pivotal edge means for guidably supporting said armature members during movement between said non-print position and said print position;

a first resilient compressible support means for continuously engaging said armature members and being located radially inwardly of said pivotal edge means and between said first armature retaining guide means and said second armature retaining guide means; and a second resilient compressible support means for engaging said armature members radially outwardly of said first resilient compressible support means and said pivotal edge means and for applying a force to said armature members opposite to the direction of movement of said armature members from the non-print position to the print position.

2. The invention as defined in claim 1 and wherein:

each of said armature members having first and second spaced radially extending parallel side surfaces;

the first side surface being located axially next adjacent said electromagnetic means and being intersected by a transverse surface to provide said pivot edge means on said armature members; and the second side surface being located axially next adjacent said armature retaining flange means.

3. The invention as defined in claim 2, wherein:

the distance between pivotal support means and said wire members being greater than the distance between said pivotal support means and said second pole portion.

4. The invention as defined in claim 3 and wherein:

the distance between said pivotal support means and said wire members being greater than approximately 60% of the distance between said second pole portion and said wire members.

5. The invention as defined in claim 1 and wherein:

said first resilient compressible support means comprising an O-ring member having circumferentially spaced portions engageable with said armature members.

6. The invention as defined in claim 5 and wherein:

said second resilient compressible support means comprising an O-ring member having circumferentially spaced portions in constant engagement with said armature members.

7. The invention as defined in claim 1 and wherein:

said wire guide housing means and said flange means being made of one piece of molded plastic material; and said first guide means and said second guide means being integrally formed on said flange portion.

8. The invention as defined in claim 7 and further comprising:

a first O-ring groove being integrally formed in said flange portion for receiving said first resilient compressible support means; and a second O-ring groove being integrally formed in said flange portion for receiving said second resilient compressible support means.

9. The invention as defined in claim 8 and wherein each of said second armature retaining guide means comprising:

a hole means in said armature member located on the central longitudinal axis of the armature; and a pin means on said flange portion extending axially toward said armature member and being located in said hole means.

10. The invention as defined in claim 9 and wherein:

said pin means and said hole means having a circular cross-sectional configuration; and the diameter of said pin means being substantially less than the diameter of said hole means to enable pivotal movement of said armature member without engagement with said pin means.

11. The invention as defined in claim 9 wherein each of said first armature retaining guide means further comprising:

a rib portion on said flange portion extending axially toward said radially innermost end portion of said armature member;

slot means in said rib portion for receiving said radially innermost end portion of said armature member; and said slot means having a larger size cross-sectional shape than the cross-sectional shape of said armature member for enabling pivotal movement of said armature member without engagement with said rib portion.

12. The invention as defined in claim 1 wherein each of said armature members comprising:

a radially outermost end portion located opposite said outer pole portion;

an intermediate portion located opposite said inner pole portion; and a radially innermost end portion extending between said intermediate portion and said print wire member.

13. The invention as defined in claim 12 wherein:

said pivotal edge means being located on and extending transversely across said intermediate portion opposite said inner pole portion for continuous pivotal abutting engagement with the flat end surface of said inner pole portion.

14. The invention as defined in claim 13 wherein:

a first flat side surface on said armature member located opposite said pole means and extending radially outwardly from said pivotal edge means to said radially outermost end portion and being engageable with said end surface of said inner pole portion and said end surface of said outer pole portion in the print position.

15. The invention as defined in claim 14 wherein:

a second flat side surface on said armature member located opposite said flange portion and extending the length of said armature member and being parallel to said first flat side surface.

16. The invention as defined in claim 15 wherein:

said radially innermost end portion of said armature member having a width approximately equal to the diameter of said wire member and being connected to said intermediate portion by radially inwardly inclined side surfaces.

17. The invention as defined in claim 16 wherein:

said inclined side surfaces intersecting said intermediate portion adjacent said inner pole means.

18. The invention as defined in claim 1 and having armature stop means located opposite said radially innermost armature end portion and comprising:

a central cavity in said electromagnetic drive housing means;

an armature abutment plate means mounted in said central cavity for abutting engagement with each of said armature members in the non-print position; and a compressible resilient spring means in said cavity between said housing means and said abutment plate means for supporting and locating said radially innermost end portions of said armature members in the non-print position and damping rebound movement upon return to the non-print position from the print position.

19. The invention as defined in claim 18 wherein said armature retaining and locating means comprising:

a resilient compressible O-ring member located between and mounted in continuous abutting engagement with said flange portion and said armature members opposite said pivotal support means.

20. The invention as defined in claim 19 and wherein:

an armature damping means mounted on said flange portion and located radially outwardly of said pivotal support means for supporting and locating said armature members in the non-print position and damping rebound movement upon return to the non-print position from the print position.

21. The invention as defined in claim 1 and wherein said electromagnetic housing means comprising:

a solid one-piece block of plastic material with said electromagnetic pole means encapsulated therewithin and having a side surface located opposite said armature members; and said pole end surfaces being substantially coplanar with and surrounded by said side surface.

22. The invention as defined in claim 21 wherein:

each of said electromagnetic means comprising a coil means and a bobbin means connected to a printed circuit board means for selectively energizing said electromagnetic means;

connection portions of said electromagnetic means being abuttingly engaged with and supported by said printed circuit board means; and said electromagnetic means and said printed circuit board means being surrounded by and fixedly located within said block of plastic material.

23. The invention as defined in claim 1 wherein each of said electromagnetic means further comprising:

said radially innermost first pole portion and said radially outermost second pole portion extending axially away from said armature members and being connected by a transverse connecting end portion.

24. The invention as defined in claim 23 and further comprising:

axially extending pole slot means being located between and defined by opposite side wall portions of said innermost first pole portion and said outermost second pole portion for separating said first pole end surface from said second pole end surface and for separating said innermost first pole portion from said outermost second pole portion beyond said connecting end portion; and said pole slot means having a variable width with a minimum width between said first pole end surface and said second pole end surface and a maximum width between opposite intermediate portions of said innermost first pole portion and said outermost second pole portion.

25. The invention as defined in claim 24 wherein:

said outer pole side wall portion being flat and extending parallel to said central longitudinal axis of said wire housing means;

said inner pole side wall portion having an inclined side surface adjacent to and intersecting said inner pole end surface and extending toward said outer pole portion; and an intermediate surface extending parallel to said outer pole side wall portion.

26. The invention as defined in claim 21 wherein:

each of said electromagnetic means comprising a coil means and a bobbin means connected to a printed circuit board means for selectively energizing said electromagnetic means; and plug-in electrical connector means on each of said bobbin means for connecting said wire coil means to said printed circuit board means.

27. The invention as defined in claim 26 wherein:

said plug-in electrical connector means and said printed circuit board means being fixedly embedded in and surrounded by said block of plastic material.

28. The invention as defined in claim 27 wherein:

a control circuit connector means mounted on said printed circuit board means and being accessible from outside said drive housing means for connecting said printed circuit board means to control circuitry for said print head assembly.

29. The invention as defined in claim 28 wherein:

said coil means and said bobbin means being embedded and fixedly mounted within said block of plastic material and a portion of said drive housing means filling a slot between said innermost pole portion and said outermost pole portion.

30. The invention as defined in claim 1 and wherein said second armature retaining and guide means for each armature member comprising:

a transversely extending retainer opening located in and extending through said armature member opposite said innermost pole portion;

a retainer pin means on said flange portion extending axially toward said innermost pole portion and extending into said retainer opening in said armature member and having a cross-sectional configuration similar to and sufficiently smaller than the cross-sectional configuration of said retainer opening to retain said armature member in operable relationship with the associated pole means while enabling free pivotal movement of said armature member without restrictive engagement with said pin means.

31. The invention as defined in claim 30 and wherein:

said retainer opening being centrally located in and along the central longitudinal axis of said armature member.

32. The invention as defined in claim 31 and wherein:

said retainer opening and said pin means have circular cross-sectional configurations.

33. The invention as defined in claim 32 and wherein:

said pin means extends through said opening and has an end surface located in abutting engagement with said first pole end surface.

34. The invention as defined in claim 33 and wherein:

said pin means and said opening are located in juxtaposition to said pivotal edge means opposite said first pole portion.

35. The invention as defined in claim 34 and wherein:

said first armature retainer and guide means further comprising:

a slot means in said flange portion located in radially inwardly spaced relationship to said pin means and said opening and having laterally spaced side surfaces for receiving an intermediate relatively narrow width portion of said armature member and said intermediate portion being located in said slot means and having a width sufficiently less than the width of said slot means to retain said armature member in radial alignment with said pole means while enabling free pivotal movement of said armature member between said non-print position and said print position without engagement with said side surfaces of said slot means.

36. The invention as defined in claim 1 and further comprising:

an armature support disk means centrally located in said drive housing means for supporting said wire drive end portions of said armature members in said non-print position.

37. The invention as defined in claim 36 and further comprises:

resilient compressible disk spring means for supporting said support disk means in said drive housing means and for maintaining said disk means in engagement with said wire drive end portions of said armature members in said non-print position while enabling movement of said support disk by resilient compression of said disk spring means.

38. The invention as defined in claim 37 and wherein:

said support disk means has a central axis which is coaxial with said central longitudinal axis of said assembly.

39. The invention as defined in claim 38 and wherein:

said support disk means has an armature abutment surface which extends at a right angle to said central axis.

40. The invention as defined in claim 39 and wherein said support disk means comprises:

a main support disk member made of rigid material; and a secondary support disk member made of resilient compressible material and mounted on said main support disk member.

41. The invention as defined in claim 40 and wherein said resilient compressible disk spring means comprising:

an O-ring member made of resilient compressible material.

42. The invention as defined in claim 37 and wherein said drive housing means comprising:

a central well means for receiving and supporting said support disk means and said resilient compressible spring means.

43. The invention as defined in claim 42 and wherein said central well means comprising:

a flat fixed support surface which is parallel with and axially offset from said pole end surfaces.

44. The invention as defined in claim 37 and further comprising:

a resilient compressible spring means for continuously engaging said armature members at a location radially inwardly spaced from said pivotal edge means and exerting a force sufficient to maintain continuous pivotal contact between said armature members and said pivot edge support surface means and to return each armature member from the print position to the non-print position and to maintain each armature member in continuous contact with said support disk means in the non-print position.

45. The invention as defined in claim 44 and further comprising:

a resilient compressible spring means mounted radially outwardly of said pivotal edge means for engaging each armature in the non-print position while being disengaged therefrom during movement between the non-print position and the print position.

46. The invention as defined in claim 1 and wherein said electromagnetic drive housing means comprising:

a body of plastic material having an outer peripheral side surface;

an inner end surface next adjacent said armature members;

an outer end surface next adjacent said printed circuit board means; and said electromagnet means being fixedly permanently mounted within and supported by said body of plastic material.

47. The invention as defined in claim 46 and wherein: said innermost first pole portion and said outermost second pole portion having pole end surfaces which are flat ground surfaces and coplanar with one another.

48. The invention as defined in claim 47 and wherein: portions of said inner end surface of said body of plastic material adjacent said pole end surfaces are flat ground surfaces and coplanar with said pole end surfaces.

49. The invention as defined in claim 48 and further comprising:

printed circuit board means connected to said electromagnet means and fixedly permanently mounted and embedded in said body of plastic material.

50. The invention as defined in claim 49 and wherein: said electromagnet means have end surfaces abutting said printed circuit board means.

51. The invention as defined in claim 50 and wherein: said electromagnet means comprises coil means and a bobbin means surrounded by and embedded within said body of plastic material.

52. The invention as defined in claim 51 and wherein said bobbin means comprising:

coil connector means for connecting said coil means to said printed circuit board means and being surrounded by and embedded within said body of plastic material.

53. The invention as defined in claim 52 and wherein said bobbin means comprising:

attachment means for connecting said bobbin means to said printed circuit board means and being embedded within and surrounded by said body of plastic material.

* * * * *